United States Patent [19]

Kreuzgruber

[11] Patent Number: 4,541,318

[45] Date of Patent: Sep. 17, 1985

[54] PRESS FOR FORMING SHEET METAL ELEMENTS

[75] Inventor: Dietrich Kreuzgruber, Leonding, Austria

[73] Assignee: Voest-Alpine Aktiengesellschaft, Linz, Austria

[21] Appl. No.: 633,787

[22] Filed: Jul. 24, 1984

[30] Foreign Application Priority Data

Aug. 17, 1983 [AT] Austria ..... 2944/83

[51] Int. Cl.[4] ..... B26F 1/14

[52] U.S. Cl. ..... 83/409; 83/552

[58] Field of Search ..... 83/409, 410, 412, 415, 83/552; 408/90, 35; 72/470

[56] References Cited

U.S. PATENT DOCUMENTS

| | | | |
|---|---|---|---|
| 3,603,187 | 9/1971 | Bredow | 83/409 X |
| 3,717,061 | 2/1973 | Daniels | 83/409 |
| 3,895,550 | 7/1975 | Daniels | 83/409 |
| 3,961,549 | 6/1976 | Smith | 83/552 |
| 4,162,641 | 7/1979 | Stubbings | 83/552 X |
| 4,412,469 | 11/1983 | Hirata et al. | 83/552 |
| 4,452,115 | 6/1984 | Bredow | 83/552 X |
| 4,486,941 | 12/1984 | Scott et al. | 83/552 X |

FOREIGN PATENT DOCUMENTS

| | | |
|---|---|---|
| 517131 | 1/1980 | Australia . |
| 518275 | 2/1980 | Australia . |
| 38199 | 10/1981 | European Pat. Off. . |
| 145234 | 12/1980 | German Democratic Rep. . |
| 2071554 | 9/1981 | United Kingdom . |

*Primary Examiner*—Donald R. Schran
*Attorney, Agent, or Firm*—Kurt Kelman

[57] ABSTRACT

In a press comprising upper and lower turntables for carrying respective sets of upper and lower press tools, each upper press tool is movable to an operating position in which said press tool is adapted to be coupled to a ram. To ensure a free access of the workpiece to the press tools adjacent to the lower press tools, each lower press tool is mounted in the lower turntable to be individually vertically displaceable relative thereto. Only the lower press tool which is in operating position is supported in the frame and the other lower press tools are lowered.

4 Claims, 6 Drawing Figures

9
16
14
10
33
12
38
4
13
11
20
21
18
5
22
38
23
33
28
29
25
29
24
28
15
2
3
1

PRESS FOR FORMING SHEET METAL ELEMENTS

BACKGROUND OF THE INVENTION

1. Field of the Invention

This invention relates to a press for forming sheet metal elements, comprising a frame, which is connected to a coordinate deck on one side thereof, upper and lower turntables carried by said frame, a plurality of angularly spaced apart upper press tools, which are carried by the upper turntable at its periphery and vertically adjustable relative to the upper turntable, a plurality of lower press tools, which are carried by the lower turntable and axially aligned with respective ones of the upper press tools, and a ram, which is carried by the frame and adapted to be coupled to each of said upper press tools in dependence on the angular position of the upper turntable.

2. Description of the Prior Art

Such presses afford the advantage that different press tools can be used to act on each workpiece without a need for an alteration of the press with high expenditures of time and labor. The press tools to be used at a time can be moved to an operating position by a rotation of the turntables carrying said press tools. In said operating position, the selected upper press tool is coupled to the ram for the working stroke. For that purpose the workpiece is so positioned on the coordinate deck associated with the press that the press tools act on the desired portion of the workpiece. The workpiece is gripped by grippers and by means of said grippers is displaced on the coordinate deck and those parts of the deck which are adjacent to the range of movement of the grippers must be lowered. In spite of that measure, the grippers cannot be moved as closely as desired to the upper and lower press tools which are in operating position because the adjacent lower press tools will obstruct the motion of the grippers adjacent to the press tools which are in operating position. For this reason the dimensions of the workpieces, particularly of relatively small workpieces, must be larger than the specified final dimensions so that the quantity of waste and the working time are increased and additional operations are required.

The need for larger dimensions may be avoided if the grippers grip the workpiece at different portions. But that regripping will necessarily involve considerable inaccuracies and an additional increase of the working time.

SUMMARY OF THE INVENTION

It is an object of the invention to avoid these disadvantages and so to improve a press of the kind described first hereinbefore that the motion of the grippers for positioning the workpiece will not be obstructed by the lower press tools carried by the lower turntable.

This object is accomplished in that each lower press tool is mounted in the lower turntable so as to be individually vertically displaceable relative thereto, the frame carries an abutment, which is vertically aligned with the ram and disposed below the lower press tools and adapted to support each of said lower press tools when it is vertically aligned with said ram, and lowering means are provided for lowering at least those of said lower press tools which are adjacent to the lower press tool which is axially aligned with said ram.

Owing to these features, at least those of the lower press tools which are adjacent to the lower press tool that is in operating position can be lowered to such an extent that the grippers for positioning the workpiece can be moved freely over said adjacent lower press tools. The lower press tool which is in operating position must be vertically displaceably mounted in the lower turntable just as the other lower press tools so that it can be lowered when an adjacent lower press tool is to be used. To ensure that the lower press tool which is in operating position can transmit the forces exerted on it, each lower press tool which has been moved to its operating position by an angular movement of the lower turntable will be vertically aligned with and supported by the abutment, which is secured to the frame, so that the workpiece will be formed under conventional conditions. When different tools are to be moved to the operating position, the previously lowered lower press tools must be raised so that they can be moved past the abutment, which is secured to the frame. Because those lower press tools which are not required are lowered, the movement of the grippers associated with the coordinate deck will not be obstructed even adjacent to the press tools so that it is not necessary to use workpieces with larger dimensions or to regrip the workpieces.

Whereas each lower press tool might be individually lowered by means of drives associated with the lower turntable, the lowering means desirably consist of a lowerable support for the lower press tools, which support is movably mounted in the frame. Because said support does not rotate in unison with the lower turntable, the means for mounting and driving such support may be very simple in structure and there is no need for separate controls for individual drives.

To ensure that the lower press tools will be positively lowered in unison with the support, the support may be formed with at least one guiding groove, which is concentric to the turntables and adapted to receive radial coupling elements, which are carried by respective ones of said lower press tools, and the support may be formed with an open-topped vertical slot, which at its lower end opens into said guiding groove and which is adapted to receive the coupling element of the lower press tool that is vertically aligned with the ram. During the rotation of the turntable, the coupling elements of the lower press tools disposed adjacent to the lowerable support extend into said guiding grooves and when the support is lowered, said adjacent lower press tools are positively lowered too. The open-topped vertical slot which is formed in the support adjacent to the abutment and opens into the guiding groove receives the coupling element of that lower press tool which is in operating position so that said lower press tool is not lowered in unison with the support because as the support is lowered the coupling element of said lower press tool will move out of the guiding groove into the slot.

Description of the Preferred Embodiments

Figure 1:
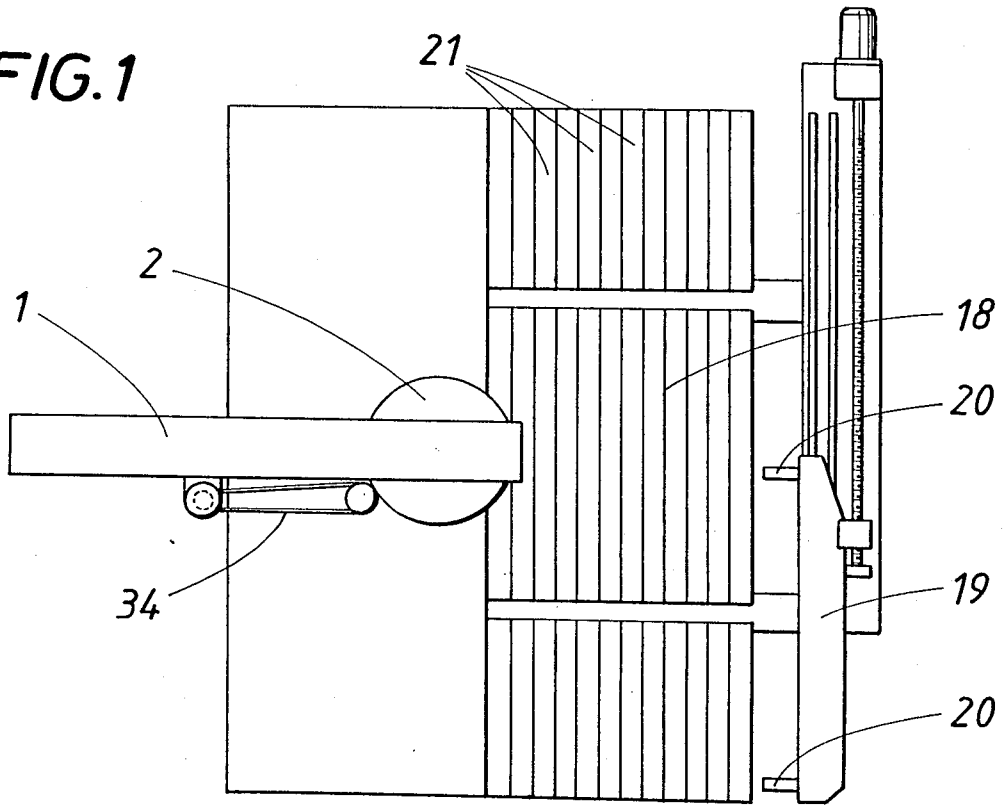
FIG. 1 is a diagrammatic top plan view showing a press in accordance with the invention for forming sheet metal elements and a coordinate table associated with the press.

The invention is illustrated on the drawings. The illustrated press comprises a substantially C-shaped frame 1, an upper turntable 2, which is mounted on the upper arm of the frame, and a lower turntable 3, which is mounted on the lower arm of said frame. The turntables 2 and 3 are coaxial. Angularly spaced apart upper press tools 4 are carried by the upper tuntable 2 at its periphery. Angularly spaced apart lower press tools 5 are carried by the lower turntable at its periphery. Each upper press tool 4 is axially aligned with a lower press tool 5 and adapted to cooperate with it. The press tools 4, 5 of each pair are moved to an operating position by an angular movement of the turntables 2, 3. The upper press tool 4 which is in operating position is vertically aligned with a ram 6 and is then coupled to the latter. In the present embodiment the ram 6 is actuated by a hydraulic cylinder 7 and in its lower end face is formed with a coupling groove 8, which is T-shaped in cross-section and extends in the peripheral direction of the turntable 2 and during the rotation of the latter is adapted to receive a complementary coupling projection 9 of each of a plurality of toolholders 10, which are carried by the upper turntable 2 and carry respective ones of the upper press tools 4. Because the upper press tools 4 mounted in the toolholder 10 are vertically displaceably mounted in the upper turntable 2, the downward actuation of the hydraulic cylinder 7 will impart a working stroke to that upper press tool 4 which is coupled to the ram 6. That working stroke may result, e.g., in the punching of a hole into the workpiece 11.

Figure 3:
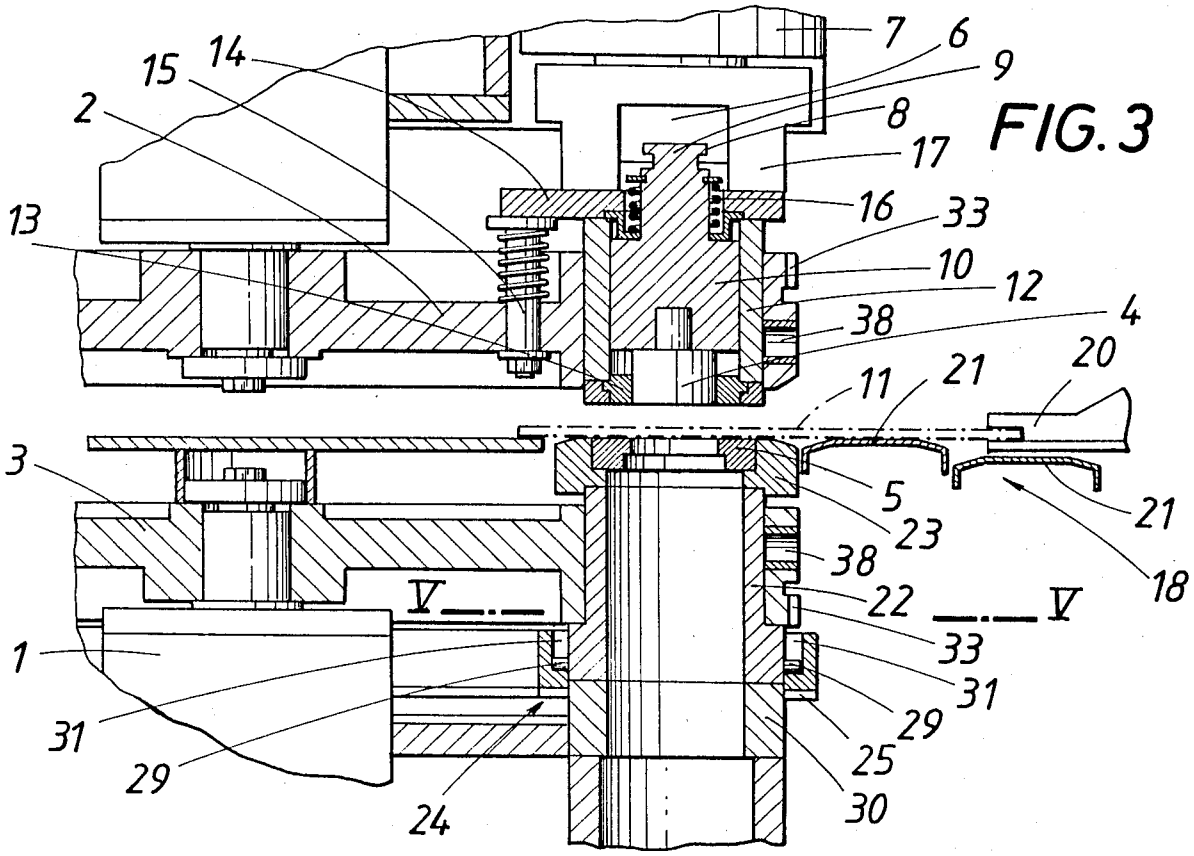
FIG. 3 is an axial sectional view showing on a larger scale the two turntables of the press adjacent to the ram.
Figure 4:
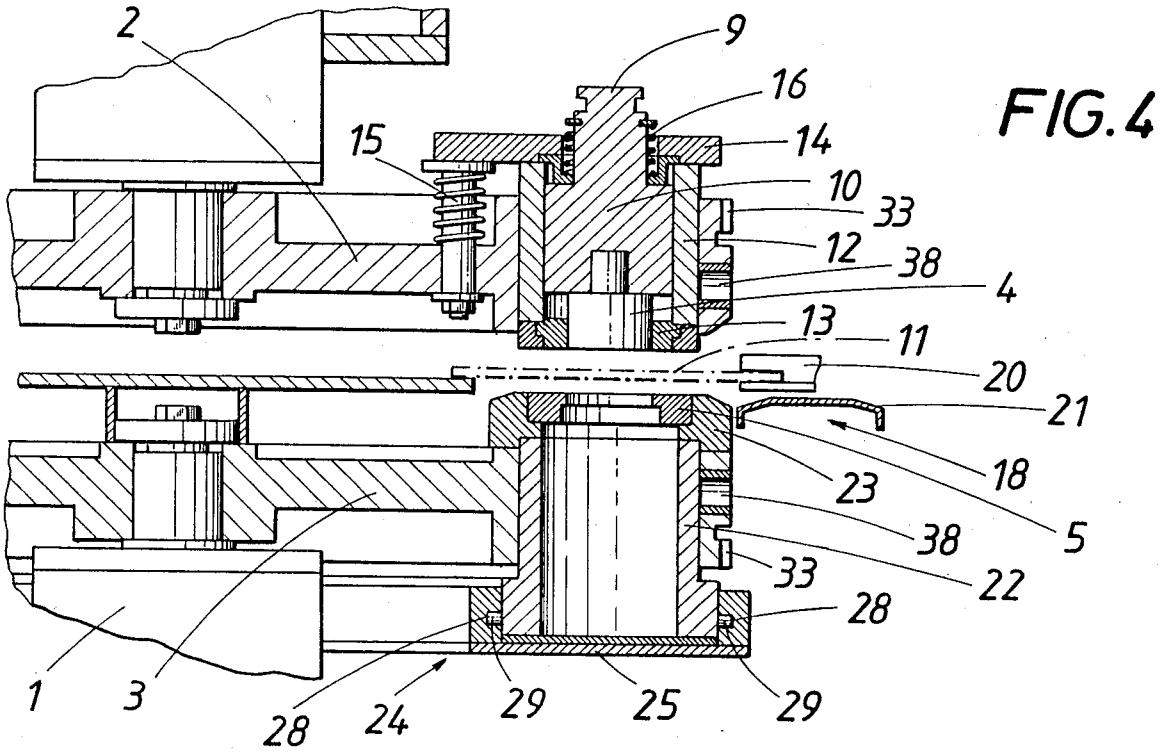
FIG. 4 is an axial sectional view which is similar to FIG. 3 but taken on a plane that is at an angle to the section plane of FIG. 3.

As is apparent from FIGS. 3 and 4, the toolholder 10 associated with each upper press tool 4 is vertically guided in bushing 12, which is vertically slidably mounted in the upper turntable 2 and carries a scraper ring 13. The bushing 12 is connected to a carrying plate 14, which is vertically supported by a spring-loaded vertical pin 5, which is vertically movably mounted in the turntable 2. As a result, the bushing 12 is held in a position of rest by the spring-loaded vertical pin 15. Opposite to the carrying plate 14 which bears on the vertical pin 15, the toolholder 10 bears on a spring 16, so that defined positions of rest are provided also for the upper press tools 4.

When an upper press tool 4 has been coupled to the ram 6, said upper press tool 4 can be lowered against the spring forces. A holding-down plunger 17 is provided, which acts on the supporting plate 14 and lowers the bushing 12 in unison with the upper press tool 4 as long as the scraper ring 13 rests on the workpiece 11. Thereafter the upper press tool is lowered relative to the scraper ring 13 and is thus forced toward the lower press tool 5 and a hole is punched into the workpiece 11. As the upper press tool 4 is retracted, the scraper ring 13 holds down the workpiece 11 so that it will not be carried along by the upper press tool 4.

On a coordinate deck 18 associated with the press, the workpiece 11 to be formed is moved to a desired position. For this purpose, grippers 20 are carried by a compound slide 19 and are movable in two directions, which are at right angles to each other. When the grippers 20 have gripped the workpiece 11, they can displace the latter on the coordinate deck to the desired position relative to the press. The deck must be lowered adjacent to the grippers 20 so that the latter can move over the lowered deck portions. In the illustrated embodiment the deck consists of individual sections 21, which are mounted to be individually vertically displaceable and each of which is lowered as the grippers approach.

Figure 2:
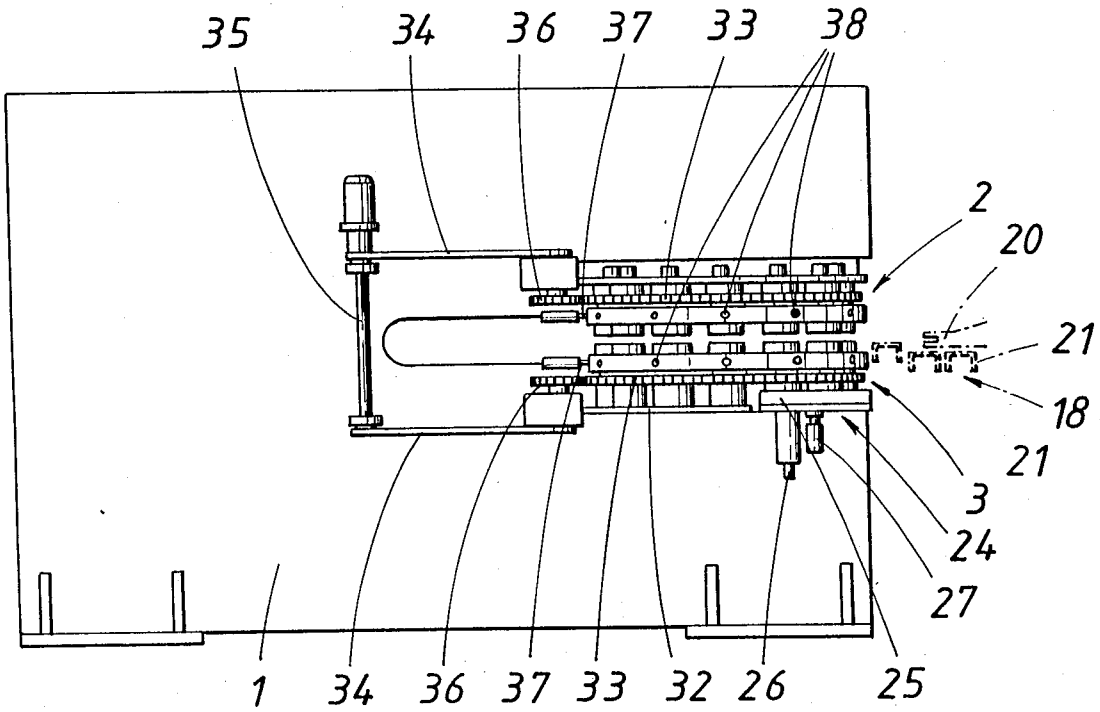
FIG. 2 is a side elevation showing that press on a larger scale.

To ensure that the grippers 20 can be displaced freely also adjacent to those lower press tools 5 which are not used at a time, the lower press tools 5 are mounted in the lower turntable 3 to be vertically displaceable relative thereto. This arrangement differs from that in the conventional presses of the present kind. As a result, the lower press tools 5 can also be lowered below the path of motion of the grippers 20. The lower press tools 5 are vertically displaceably mounted by means of pressure sleeves 22, which are vertically displaceably mounted in the lower turntable 3 and each of which carries near its upper end a toolholder 23 for one of the lower press tools 5. The means 24 for lowering the lower press tools comprise a support 25, which is adapted to support the lowerable lower press tools 5. By means of sliding rod 26, that support 25 is slidably guided in the frame 1. The support 25 is adapted to be raised and lowered by means of a cylinder 27 (FIG. 2). To ensure that the lower press tools 5 which are not used will actually be lowered, the support 25 is formed with two guiding grooves 28, which are coaxial to the lower turntable 3 and are adapted to receive a coupling element 29 of each lower press tool 5. During an angular movement of the lower turntable 3, the coupling elements 29 carried by the pressure sleeves 22 enter the guiding grooves of the support 25, which has the configuration of a sector of a circular ring, and if the cylinder 27 is properly actuated the support 25 is adapted to lower those coupling elements 29 which have entered the guiding grooves 28. Obviously that lower press tool 5 which is axially aligned with the ram 6 must not be lowered. This is ensured by an abutment 30, which is secured to the frame and vertically aligned with the ram 6. As is apparent from FIG. 3, the pressure sleeve 22 of that lower press tool 5 which is vertically aligned with the ram 6 rests on said abutment 30. The coupling elements 29 of that lower press tool 5, which is held against vertical displacement, must not obstruct the lowering of the support 25 for the adjacent lower press tools. This is ensured in that the support 25 is formed adjacent to the abutment 30 with open-topped vertical slots 31, which at their lower end open into the guiding grooves 28 and through which the coupling elements 29 can leave the guiding grooves 28 as the support is lowered. When different press tools are to be moved to the operating position, the support 25 must be raised to its initial position so that the lower press tools can be moved past the abutment 30. Each pressure sleeve 22 which has left the support 25 slides up on stationary guiding surfaces 32, which are provided on the frame 1 and ensure that the slidably mounted lower press tools 5 will move to their initial position.

As is particularly apparent from FIG. 4, the lowering of those lower press tools 5 which are not used at a time provides a free path for the movement of the grippers 20 so that no limits to the adjustment of the movement 11 are imposed by said lower press tools.

For the angular movement of the turntables 2 and 3, each of them may be provided in the conventional manner with gears 33, which are in mesh with pinions driven via belt or chain drives 34 from a common drive shaft 35. The angular positions of the turntables 2 and 3 are defined by means of radial pins 37, which enter corresponding centering bushings 38 of the turntables 2 and 3 and can be pneumatically or hydraulically actuated.

Figure 5:
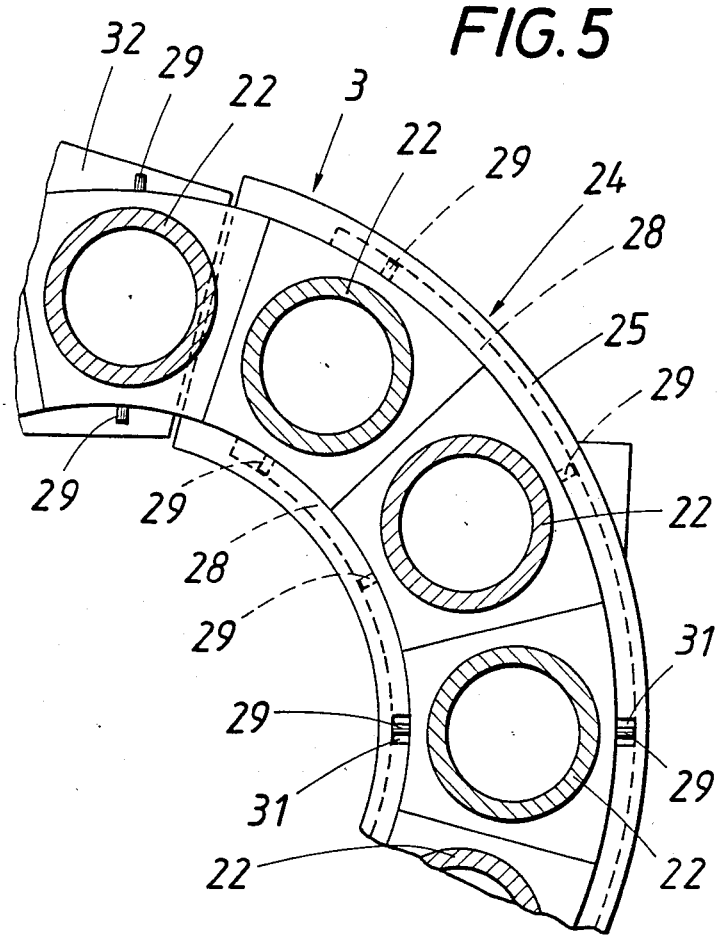
FIG. 5 is a sectional view taken on line V—V of FIG. 3.
Figure 6:
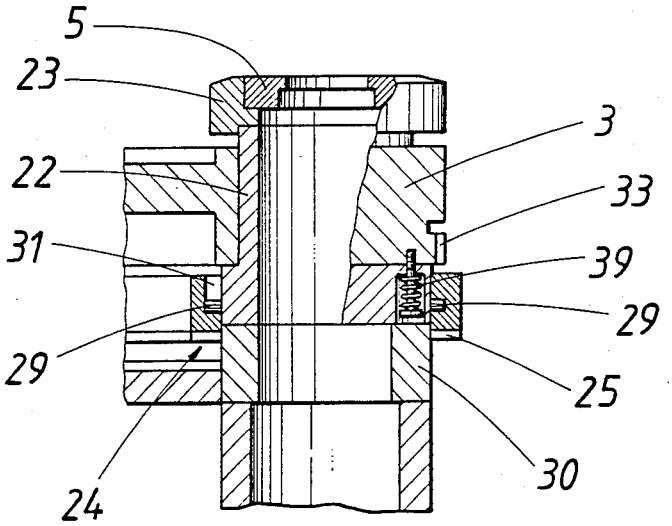
FIG. 6 is a vertical sectional view showing a modified design of the means for mounting the lower press tools in the lower turntable.

In accordance with FIG. 6 the pressure sleeves 22 are supported on the lower turntable 3 by means of springs 39, which hold the pressure sleeves 22 in their raised position so that there is no need for the guiding surfaces 32 shown in FIG. 5. As the lower press tools 5 which are not used at a time are lowered, the pressure sleeves 22 are lowered against the force of said springs 39.

What is claimed is:

1. In a press for forming sheet metal elements comprising a frame, an upper turntable mounted in said frame for rotation on a vertical axis, a lower turntable disposed under said upper turntable and mounted in said frame for rotation on said axis, a plurality of angularly spaced apart, downwardly facing upper press tools, which are mounted on said upper turntable with the same radial spacing from said axis and are vertically displaceable relative to said upper turntable, a plurality of angularly spaced apart, upwardly facing lower press tools mounted on said lower turntable and vertically aligned with respective ones of said upper press tools a punch, which is mounted in said frame with approximately the same radial spacing from said axis as said upper press tools and is vertically movable relative to said frame, means for rotating said upper and lower turntables in unison about said axis to a plurality of angular positions, in which respective ones of said upper press tools are vertically aligned with said ram, coupling means for coupling said ram to each of said upper press tools when the same is vertically aligned with said ram, and ram-actuating means for vertically reciprocating said ram, the improvement residing in that each of said lower press tools is mounted in said lower turntable to be individually vertically movable relative to said lower turntable to and from a lower position, in which said lower press tool protrudes below said lower turntable, said frame carries an abutment, which is disposed below said lower turntable and axially aligned with aid ram and is adapted to support each of said lower press tools in a position above said lower position when said lower press tool is vertically aligned with said ram, and lowering means are provided for moving those of said lower press tools which are adjacent to the lower press tool that is vertically aligned with said ram to said lower position.

2. The improvement set forth in claim 1, wherein said lowering means comprise a support, which is mounted on said frame and vertically movable relative thereto and adapted to support those of said lower press tools which are adjacent to said lower press tool which is vertically aligned with said ram.

3. The improvement set forth in claim 2, wherein each of said lower press tools carries a radially extending coupling element, said support is formed with at least one radially open, arcuate guiding groove, which is centered on said axis and is adapted to receive said coupling elements of both of said lower press tools which are adjacent to said upper press tool that is vertically aligned with said ram, and said support is formed with an open-topped vertical slot, which at its bottom opens into said guiding groove and which is adapted to receive said coupling element of said lower press tool which is axially aligned with said ram.

4. In the combination of a coordinate deck for supporting a sheet metal element, gripping means for positioning said sheet metal element on said coordinate deck so that said sheet metal element protrudes laterally from said deck on one side thereof, and press for forming said sheet metal element, which press comprises a frame disposed on said one side of said deck, an upper turntable mounted in aid frame for rotation on a vertical axis, a lower turntable disposed under said upper turntable and mounted in said frame for rotation on said axis, a plurality of angularly spaced apart, downwardly facing upper press tools, which are mounted on said upper turntable with the same radial spacing from said axis and are vertically displaceable relative to said upper turntable, a plurality of angularly spaced apart, upwardly facing lower press tools mounted on said lower turntable and vertically aligned with respective ones of said upper press tools, a punch, which is mounted in said frame with approximately the same radial spacing from said axis as said upper press tools and is vertically movable relative to said frame, means for rotating said upper and lower turntables in unison about said axis to a plurality of angular positions, in which repsective ones of said upper press tools are vertically aligned with said ram, coupling means for coupling said ram to each of said upper press tools when the same is vertially aligned with said ram, and ram-actuating means for vertically reciprocating said ram, the improvement residing in that each of said lower press tools is mounted in said lower turntable to be individually vertically movable relative to said lower turntable to and from a lower position, in which said lower press tool protrudes below said lower turntable, said frame carries an abutment, which is disposed below said lower turntable and axially aligned with said ram and is adapted to support each of said lower press tools in a position above said lower position when said lower press tool is vertically aligned with said ram, and lowering means are provided for moving those of said lower press tools which are adjacent to the lower press tool that is vertically aligned with aid ram to said lower position.

* * * * *